United States Patent [19]

Horimatsu

[11] Patent Number: 4,591,297

[45] Date of Patent: May 27, 1986

[54] METHOD OF BUILDING STRENGTHENED, EMBANKED FOUNDATION

[75] Inventor: Kazuo Horimatsu, Funabashi, Japan

[73] Assignee: Tekken Construction Co., Ltd., Tokyo, Japan

[21] Appl. No.: 602,077

[22] Filed: Apr. 19, 1984

[51] Int. Cl.[4] ..... E21D 9/00

[52] U.S. Cl. ..... 405/258; 405/132; 405/138; 405/146

[58] Field of Search ..... 405/132, 258, 138, 146, 405/141, 150, 139, 140, 149, 284, 285; 299/11, 19, 31, 32

[56] References Cited

U.S. PATENT DOCUMENTS

| | | | |
|---|---|---|---|
| 3,925,994 | 12/1975 | Broms et al. | 405/258 |
| 4,009,579 | 3/1977 | Patzner | 405/138 |
| 4,150,910 | 4/1979 | Maffei | 405/149 |
| 4,329,089 | 5/1982 | Hilfiker et al. | 405/262 |
| 4,345,856 | 8/1982 | Tuck | 405/258 |
| 4,421,439 | 12/1983 | Burg et al. | 405/258 |
| 4,519,730 | 5/1985 | Horimatsu | 405/138 |

OTHER PUBLICATIONS

"Nikkan Kensetsu Kogyo Shinbun" (Daily Construction Industry News as literally translated), dated Dec. 16, 1983, article entitled A Tunnel Excavated in Vertically High Embanked Structure, Tekken Construction Co., Ltd. Tested.

*Primary Examiner*—Dennis L. Taylor

*Attorney, Agent, or Firm*—Leydig, Voit & Mayer, Ltd.

[57] ABSTRACT

A method of building a strengthened, embanked foundation capable of forming therein a tunnel comprising steps of burying, during embanking work of lower part of the foundation, a plurality of nets as vertically spaced in embanking material for the foundation at least in its internal zone including side wall portions of the tunnel later formed so as to substantially horizontally intersect imaginary sliding surfaces occurring in the portions upon excavation of the tunnel, forming a crushed-stone arch layer overlying from both upper side portions to upper central portion of the later formed tunnel during further course of the embanking, work providing a hanging support to ceiling wall portion of the later formed tunnel as coupled through hanging rods to the arch layer during its formation, and, after completion of the embanking, excavating a zone defined by the side and ceiling wall portions in the embanked foundation to form the tunnel therein. During this excavation, the imaginary sliding surfaces are subjected to an effective restraining force produced by optimum interlocking of the buried nets with the embanked material, and the side and ceiling wall portions of the excavated tunnel are provided with an effective resisting stress against vertical and horizontal ground pressure resulting from the restraining force and hanging support as well as a self-supporting force of the arch layer, whereby the strengthened, embanked foundation highly stable can be obtained.

6 Claims, 4 Drawing Figures

METHOD OF BUILDING STRENGTHENED, EMBANKED FOUNDATION

TECHNICAL BACKGROUND OF THE INVENTION

This invention relates to a method of building a strengthened, embanked foundation of roadbed and the like.

When such a new road as a high way is constructed to intersect already existing roads, water-ways or the like, there has been generally employed a method of building an embankment at least over the existing road or the like to have the new road constructed on the embankment in a two level crossing. In this case, it is necessary to build a hollow structure transversely through the embankment so as to secure a space necessary for retaining the existing road or the like. Specifically, such hollow structure includes a concrete-made tunnel, substructures for a bridge, box structure or the like, and the peripheral portions of this structure must be sufficiently stabilized for preventing its side walls and ceiling from being broken or collapsed.

DISCLOSURE OF PRIOR ART

Referring more specifically to this conventionally employed method with reference to FIG. 1, when a new road NR is constructed, a buried hollow structure SB such as a tunnel is initially built with concrete or the like material over each of, for example, an existing road OR and a waterway WR, and thereafter an embankment is to be constructed further over these structures SB for the new road construction but, in order to transport embanking materials to the intended site of the new road, it is necessary to provide preparatory construction roads PR leading to respective parts of the site between the existing road OR and the water-way WR and beyond the former.

According to this method, however, the embanking work for the new road construction must be performed after sufficient hardening of such material of the structure SB as concrete because, at each time when the new road crosses each existing road or the like, the structure SB must be built prior to the new road construction, and it has been impossible to continuously construct the new road but only intermittently, so that the construction period would be easily prolonged. Yet, the provision of the preparatory construction roads PR has been generally necessary for avoiding any additional prolongation of the construction period caused inherently when the intermittently constructed new road is utilized for the transport of embanking material, whereby a considerably larger amount of costs has been required and it has been occasionally impossible to provide the construction road for geographic reasons. To overcome these drawbacks, a method for constructing an underground structure is proposed in U.S. Pat. No. 4,519,730 issued to Applicant.

A primary object of the present invention is, therefore, to provide a method of building a strengthened, embanked foundation which allows a continuous construction of a new road or the like without any interruption so as to be achievable even when the new road crosses existing roads, water-ways and the like.

Another object of the present invention is to provide a method of building a strengthened, embanked foundation of a new road to effectively utilize the new road being constructed to perform the embanking work for its crossing zone with existing roads and the like, thereby eliminating the need to construct the preparatory construction road for such work.

Still another object of the present invention is to provide a method of building a strengthened, embanked foundation of a new road, which contributes to a remarkable reduction of required construction period for the new road and is thus high in the economy.

Other objects and advantages of the present invention shall be made clear in the following explanation of the invention detailed with reference to an embodiment shown in accompanying drawings, in which

BRIEF DESCRIPTION OF THE DRAWINGS

FIG. 1 is a schematic diagram for explaining a conventional method of constructing a new road transversing existing road and the like;

It should be understood that the present invention is not limited only to the illustrated embodiment but is to rather include all alterations, modifications and equivalent arrangements possible within the scope of appended claims.

DESCRIPTION OF PREFERRED EMBODIMENT

The method of building strengthened, embanked foundation according to the present invention shall be detailed with reference to FIGS. 2 through 4.

Figure 1:
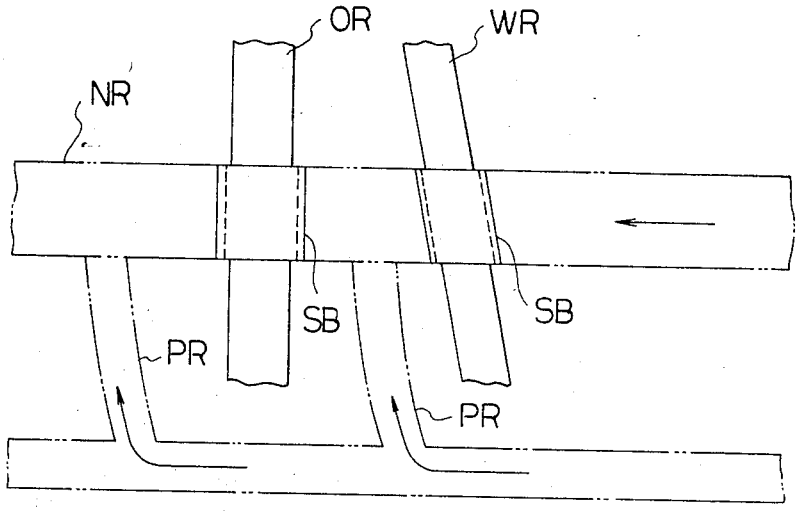
Figure 2:
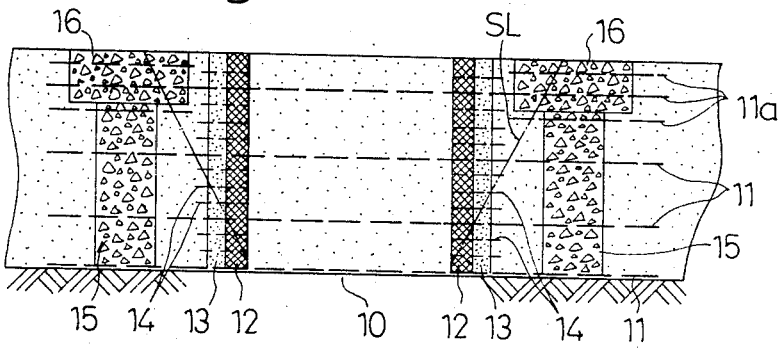
FIG. 2 is a fragmentary section of the strengthened, embanked foundation being built for a new road construction according to an embodiment of the present invention, for explaning a state in which side wall portions and adjacent pillar-shaped crushed-stone layers of a tunnel later formed in the foundation are being built.

Referring first to FIG. 2 which illustrates an embodiment of the present invention, a buried net 11 made preferably of polyethylene threads is initially placed horizontally on a ground surface 10 preferably over the entire area of the site where the embanking is performed for building the foundation. For the buried net 11, it is preferable to employ the synthetic resin threads of polyethylene series having a tensile elastic modulus of 7.0 $Kg/cm^2$. A plurality of these threads are meshed to provide a grid of 2.5 to 3.0 cm with an allowable tensile-resisting stress of about 1,000 Kg/m.

In order to form two opposing side wall portions of a tunnel of a rectangular section as spaced horizontally and erected vertically on the ground surface 10 inside the embankment, a pair of soil cement layer 12 for each cemented side wall of the tunnel and a slope soil layer 13 on each opposite outer side of the cemented side walls are built up on the buried net 11 as spaced horizontally and erected vertically, with a plurality of slope nets 14 embedded in these layers 12 and 13 as vertically spaced at intervals of about 10 to 15 cm. These slope nets 14 are preferably of polyethylene series threads of a smaller size in the diameter and meshed grid than that of the buried net 11 so as to have an allowable tensile-resisting stress of about 500 Kg/m. The width of the slope nets 14 is selected to be enough for extending from the inner face of the coil cement layer 12 through the layers 12 and 13 and sufficiently into the embanked material outside the layers 13.

In the embanked material outside the respective side wall portions of the layers 12 and 13, a pair of pillar-shaped crushed-stone layers 15 are erected and spaced a predetermined distance from each slope soil layer 13, bearing the spaces between the opposing side wall portions, between each side wall portion of the layer 13 and each crushed-stone layer 15 and the remaining portions outside layers 15 for embankment over the length of the tunnel. The width of the foundation between the two opposing side wall portions of the layer 12 is the width of the tunnel. During such embanking, a plurality of further buried nets 11 are placed on every layer preferably of 40–60 cm height of embanked material, concurrently with the formation of the respective side wall portions 12, 13 and crushed-stone layers 15, these further buried nets 11 having a width enough for being spread over an area across the both pillar-shaped crushed-stone layers 15 and reaching further outside these layers 15. In this case, it should be readily understood by any skilled in the art that these further buried nets may be substantially of the same size as the initially buried net immediately on the ground surface, or vice versa.

In the present instance shown, therefore, the lower part of the foundation including the side wall portions of the tunnel to be formed later is built with three of the slope nets 14 buried between respective buried nets 11 as spaced vertically from and parallelly to each other, while the embanking is repetitively performed with a sufficient rolling compaction also repeated simultaneously with such steps as described above of forming the respective layers 12, 13 and 15.

As the embanking has advanced to a predetermined height of the tunnel's side wall portions and erected crushed-stone layers 15, a foundation layer 16 of crushed-stone is formed on each of the erected layers 15 together with a plurality of relatively narrower buried nets 11*a* also mutually spaced vertically and spread beyond the width of the layer 16 which is relatively larger than the height and aligned at the center with the layer 15.

Figure 3:
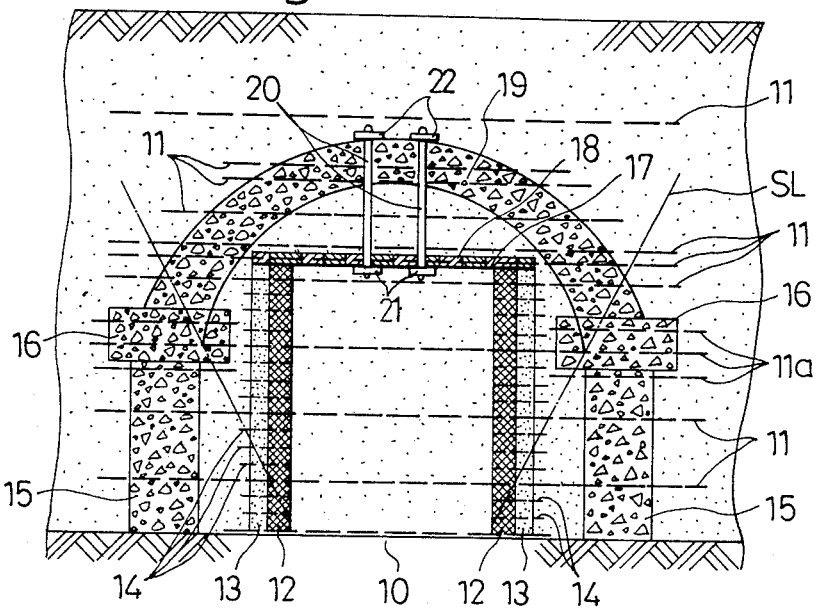
FIG. 3 is a fragmentary section of the foundation completed following the state of FIG. 2.

Referring next to FIG. 3, it will be seen that a further upper part of the foundation is embanked above the crushed-stone foundation layers 16, repeating the steps of forming the soil cement layers 12 and slope soil layers 13 and, when the layers 12 and 13 of the tunnel's side wall portions reach a required height for the tunnel, the embanked layers are flatened as sufficiently subjected to the roll compaction to the level of the height. Thereafter, a sheet member 17 is placed across the upper ends of the opposing side wall portions, and a ceiling wall layer 18 is formed with soil cement all over the sheet member 17. In forming the ceiling wall layer 18, preferably, more than two of the buried nets 11 are horizontally placed to be embedded in this layer 18 in vertically closer spaced relation to each other so that the layer 18 will be thereby reinforced. For the sheet member 17, a plastic made sheet material may be effectively employed, or any of such rigid member as a rustproof steel plate, concrete plate and the like may even be used alternatively.

Referring further to FIG. 3, it will be also seen that, during the foregoing embanking of the further upper part and subsequent embanking of still further upper part or top part of the foundation being built, a crushed-stone arch layer 19 substantially of semicylindrical dome-shaped structure is formed across the both crushed-stone foundation layers 16 so as to enclose the upper part of the tunnel's side wall portions and ceiling wall portion. During the formation of the arch layer 19, further, a plurality of hanging rods 20 interlocked at their lower end through any known means such as a washer to either one or both of the sheet member 17 and the buried net 11 in the ceiling wall layer 18 are provided as disposed at may positions both in the width and longitudinal directions of the tunnel to be formed (only two of which rods are shown in the drawing). In this case, preferably, stringers 21 extending in the tunnel's longitudinal direction are provided against the lower surface of the sheet member 17 so that the lower ends of the hanging rods 20 may be coupled to these stringers 21 and thereby a supportive hanging force of the rods to the ceiling wall layer 18 may be increased. The upper ends of these hanging rods 20 are extended above the top part of the crushed-stone arch layer 19 and are secured to stringers 22 provided on the top part in the longitudinal direction of the tunnel to be formed, so that the rods 20 will be effectively coupled to the arch layer 19 to achieve the supportive hanging force to the ceiling wall layer 18. The subsequent embanking for the further and top parts of the foundation is thereafter continued up to a predetermined height with repetition of the provision of any further buried nets 11 and of the roll compaction, so as to complete the embanking for the strengthened foundation.

Figure 4:
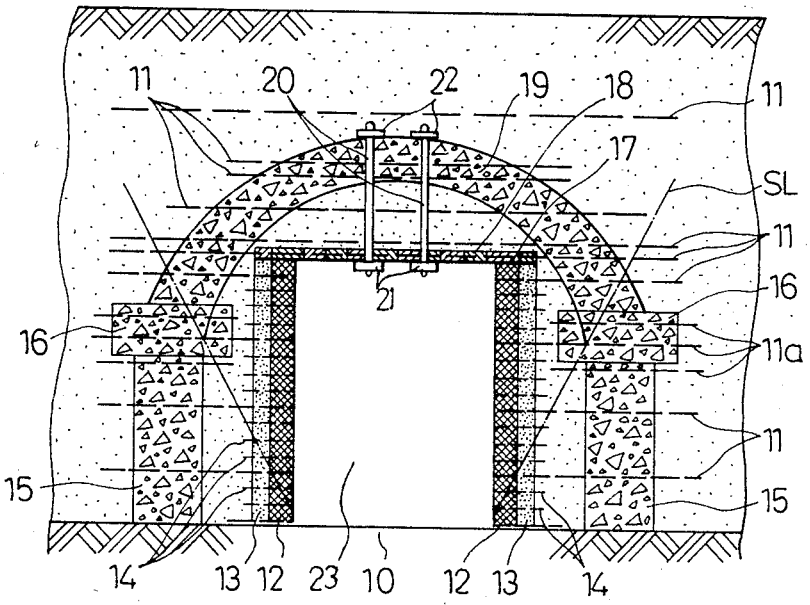
FIG. 4 is a fragmentary section of the foundation similar to FIG. 3 but in a state in which the tunnel is formed in the foundation.

After the completion of the embanking, as shown in FIG. 4, the embanked material in the region surrounded by the opposing side wall portions comprising the soil cement layers 12 and slope soil layers 13, as well as the ceiling wall layer 18 and ground surface 10 is excavated and removed with the buried nets 11 lying within the region also cut and removed, and a tunnel 23 is formed in the strengthened foundation. During this tunnel excavation, it is likely that the embanked material tends to slide along the imaginary sliding surfaces such as shown by chain lines SL in the drawing and normally occurring diagonally through the both side wall portions of the excavated tunnel, from the base parts of the crushed-stone arch layer 19 and its foundation layers 16 through the embanked material inside the pillar-shaped crushed-stone layers 15 to the respective base parts of the soil cement and slope soil layers 12 and 13 in the present instance, which generally entailing in a collapse of the wall portions. According to the present invention, however, the side wall portions of the tunnel 23 are sufficiently strengthened for not causing such sliding nor the collapse as above, by means of interlocking action of the respective buried nets 11 and slope nets 14 with the soil cement, slope soil and crushed stone forming the respective layers 12, 13, 16 and 19 as well as the embanked material of the side wall portions. More in detail, a tensile force due to a sliding force caused along the sliding surfaces SL is imparted to the respective buried and slope nets 11 and 14 lying horizontally through the sliding surfaces SL and, once such tensile force is imparted, the respective materials compacted within respective net meshes to form in microscopic view a pillar-shaped body in each mesh are caused to receive a shearing force of the net-forming threads but this shearing force transmitted to the respective pillar-shaped bodies in the net meshes act to cancel the tensile force, whereby the entire materials outside the sliding surfaces SL can be stably retained. In other words, so long as the total strength of the respective nets and pillar-shaped bodies of the materials forming the side wall portions is larger than the sliding force, the nets and pillar-shaped bodies will not behave themselves independently of each other but as integralized with each other and even with the materials inside the sliding surfaces, so as to stabilize the side wall portions remarkably reliably with respect to the sliding surfaces. In addition, the respective buried nets in the crushed-stone layers 16 and 19 will act to prevent these layers from being horizontally displaced while increasing the horizontal shearing force of the nets and, in this respect, too, the stabilization of the side wall portions can be also effectively achieved. The foregoing interlocking feature is also applicable to the relationship between the buried nets 11 and the embanked material in any other portion of the embanked foundation.

During the excavation of the tunnel 23, on the other hand, the ceiling wall portion of the tunnel is also apt to fall and collapse, but the vertical and horizontal ground pressures likely to occur are born by the crushed-stone arch layer 19 and foundation layers 16 and eventually by the pillar-shaped crushed-stone layers 15 and any collapse of the ceiling wall portion can be effectively prevented from occurring. In interposed layers of the embanked material between the arch layer 19 and the ceiling wall layer 18, a relatively smaller vertical ground pressure is still present to cause the layer 18 to settle. However, this vertical ground pressure is born specifically by the supportive hanging force of the hanging rods 20 and stringers 21 and 22 coupled to the rods and any settling of the ceiling wall layer 18 can be effectively prevented from occurring.

As a result, all peripheral portions of the tunnel 23 can be stabilized substantially completely even after the excavation of the tunnel. Exposed tunnel wall surface may be subjected to a cement casting or the like. Further, the soil cement layers 12 may be replaced by a concrete structure. The number of the buried and slope nets 11, 11*a* and 14 and of the combination of the hanging rods 20 and stringers 21 and 22 may properly be selected depending on the scale of the embanked foundation to be built. Further, while a plurality of pairs of the pillar-shaped crushed-stone layers 15 are provided along the length of the tunnel and these layers 15 may be formed in the form of continuous wall body if occasion demands, they can even be omitted so long as the embanking material compacted between the ground surface 10 and the respective crushed-stone foundation layers 16 for the arch layer 19 provides a sufficient supporting to the layer 18, without imparing the bearing function of the crushed-stone foundation and arch layers 16 and 19.

According to the method of the present invention as has been disclosed, the embanked layers even right above the excavated tunnel in the strengthened, embanked foundation can sufficiently endure the load of running vehicles during the continuous construction of the foundation for the new road or the like, trucks for transporting the embanking material and so on can be allowed to run immediately on the just embanked new road having the excavated tunnel and thus it is made unnecessary to provide any construction road for the new road construction. Since it is unnecessary to wait for completion of the hollow structure as in the past, the new road can be extended even before excavation of the tunnel, so that the construction period can be remarkably shortened and the construction can be well economized.

What is claimed as my invention is:

1. A method of building a strengthened, embanked foundation of roadbed including a tunnel in an embankment during its embanking work at a position corresponding to an existing road, waterway or the like in constructing a new road across said existing road or the like with said embankment, the method comprising the steps of forming at least a slope soil layer erected to form each of opposing side walls of said tunnel to be later excavated for said foundation, with a plurality of buried nets mutually vertically spaced and substntially intersecting an imaginary sliding surface appearing in the layers when excavating said tunnel between said side walls, performing said embanking work for building said foundation including peripheral portions of said slope soil layers, forming in the foundation being embanked an arch-shaped crushed-stone layer across both upper side parts of said tunnel, forming inside said crushed-stone layer a ceiling wall layer providing a hanging force with the crushed-stone layer as a supporting means, continuing said embanking work on already acheived embankment, and excavating a zone inside the slope soil and ceiling wall layers to form the tunnel while cutting and removing said buried nets lying within said zone.

2. A method according to claim 1 wherein said step of forming said slope soil layers comprises a step of forming a soil cement layer inside each of said slope soil layers while embedding slope nets extending through said soil cement and slope soil layers between respective said buried nets.

3. A method according to claim 1 wherein said step of forming said ceiling wall layer comprises a step of forming a ceiling soil cement layer across said slope soil layers with further buried nets embedded in said ceiling soil cement layer.

4. A method according to claim 1 wherein said step of forming said ceiling wall layer comprises a step of coupling a hanging rod means secured at an end to a stringer means provided against the lower surface of the ceiling wall layer to another stringer means provided on the top part of said arch-shaped crushed-stone layer at the other end.

5. A method according to claim 1 which further comprises a step of forming a foundation layer of crushed-stone immediately below each side lower end of said arch-shaped crushed-stone layer during said step of performing said embanking work.

6. A method according to claim 5 which further comprises a step of forming a pillar-shaped crushed-stone layer between each of said foundation layer and the ground surface.

* * * * *